US011078824B2

(12) United States Patent
Kagawa

(10) Patent No.: US 11,078,824 B2
(45) Date of Patent: Aug. 3, 2021

(54) COOLING SYSTEM

(71) Applicant: JTEKT Corporation, Osaka (JP)

(72) Inventor: Hiroki Kagawa, Kashiba (JP)

(73) Assignee: JTEKT Corporation, Osaka (JP)

( * ) Notice: Subject to any disclaimer, the term of this patent is extended or adjusted under 35 U.S.C. 154(b) by 0 days.

(21) Appl. No.: 16/742,959

(22) Filed: Jan. 15, 2020

(65) Prior Publication Data

US 2020/0240317 A1 Jul. 30, 2020

(30) Foreign Application Priority Data

Jan. 25, 2019 (JP) ..... JP2019-011461

(51) Int. Cl.
*F01P 7/14* (2006.01)
*F01P 11/14* (2006.01)
*F01P 5/12* (2006.01)

(52) U.S. Cl.
CPC ..... *F01P 7/14* (2013.01); *F01P 5/12* (2013.01); *F01P 2023/00* (2013.01); *F01P 2025/13* (2013.01); *F01P 2025/30* (2013.01)

(58) Field of Classification Search
CPC .... F01P 2025/30; F01P 3/20; F01P 2005/125; F01P 11/14; F01P 2060/00; F01P 2060/04; F01P 2060/185; F01P 7/14; F01P 2025/50; F01P 2060/02
See application file for complete search history.

(56) References Cited

U.S. PATENT DOCUMENTS 5,390,632 A 2/1995 Ikebe et al.
2002/0152972 A1* 10/2002 Iwasaki ..... F01P 7/164 123/41.44
2014/0000859 A1 1/2014 Abihana
2015/0134124 A1* 5/2015 Carter ..... F24F 11/30 700/278
2016/0333829 A1* 11/2016 Takahashi ..... F01P 7/16
2017/0152790 A1* 6/2017 Morishima ..... F02M 35/10268

FOREIGN PATENT DOCUMENTS

JP 2006-112330 A 4/2006

OTHER PUBLICATIONS

Extended European Search Report dated May 29, 2020 in Patent Application No. 20152404.8, 6 Pages.

* cited by examiner

*Primary Examiner* — Long T Tran

(74) *Attorney, Agent, or Firm* — Oblon, McClelland, Maier & Neustadt, L.L.P.

(57) ABSTRACT

A cooling system includes an electric pump, a cooling target temperature sensor, a coolant temperature sensor, and an electronic control unit. The electric pump pumps a coolant to a circulation channel connected to an inlet and an outlet of a cooling channel in which heat is exchanged with a cooling target. The cooling target temperature sensor detects a cooling target temperature. The coolant temperature sensor is arranged upstream of the inlet in the circulation channel, and detects a coolant temperature. The electronic control unit controls driving of the electric pump so that a discharge flow rate of the electric pump matches a target flow rate, and sets the target flow rate using an equation based on a reference value obtained by dividing a difference between the cooling target temperature and a target cooling temperature of the cooling target by a difference between the cooling target temperature and the coolant temperature.

2 Claims, 3 Drawing Sheets

COOLING SYSTEM

INCORPORATION BY REFERENCE

The disclosure of Japanese Patent Application No. 2019-011461 filed on Jan. 25, 2019 including the specification, drawings and abstract is incorporated herein by reference in its entirety.

BACKGROUND

1. Technical Field

The present disclosure relates to a cooling system.

2. Description of Related Art

There has been proposed a cooling system that cools an engine by circulating a coolant through a coolant circulation path including a radiator passage and a water jacket of the engine (see, for example, Japanese Unexamined Patent Application Publication No. 2006-112330 (JP 2006-112330 A)). In the cooling system described in JP 2006-112330 A, a water pump that operates in conjunction with rotation of the engine sucks the coolant flowing through the radiator passage and discharges the coolant to the water jacket of the engine, thereby circulating the coolant through the coolant circulation path. During the circulation, the coolant absorbs heat radiated from the engine while passing through the water jacket and rises in temperature. Then, the coolant releases heat while passing through the radiator passage and falls in temperature.

The cooling system described in JP 2006-112330 A is provided with a bypass passage that bypasses the radiator passage. One end of the bypass passage is connected between the radiator and an outlet of the water jacket. The other end of the bypass passage is connected to the radiator passage between the radiator and the water pump. A flow rate control valve for adjusting a flow rate of the coolant passing through the radiator is provided at a connection portion between the other end of the bypass passage and the radiator passage. By adjusting the flow rate control valve, a coolant temperature is controlled to a target coolant temperature.

SUMMARY

In the cooling system described in JP 2006-112330 A, in order for an electronic control unit (ECU) for controlling the coolant temperature to set various maps for adjusting the flow rate control valve, various experiments using system models are required. This may require a lot of labor and time, causing an increase in development cost. In addition, since an amount of data of the maps are larger than that of equations, a memory having a large data capacity is required as a memory for storing the maps, resulting in high part cost and high manufacturing cost.

The present disclosure provides a cooling system involving low manufacturing cost.

An aspect of the present disclosure provides a cooling system. The cooling system includes an electric pump, a cooling target temperature sensor, a coolant temperature sensor, and an electronic control unit. The electric pump is configured to pump a coolant to a circulation channel connected to an inlet and an outlet of a cooling channel in which heat is exchanged with a cooling target. The cooling target temperature sensor is configured to detect a cooling target temperature that is a temperature of the cooling target. The coolant temperature sensor is arranged upstream of the inlet in the circulation channel and configured to detect a coolant temperature that is a temperature of the coolant. The electronic control unit is configured to control driving of the electric pump so that a discharge flow rate of the electric pump matches a target flow rate. The electronic control unit is configured to set the target flow rate by using an equation based on a reference value obtained by dividing a difference between the cooling target temperature detected by the cooling target temperature sensor and a target cooling temperature of the cooling target by a difference between the cooling target temperature detected by the cooling target temperature sensor and the coolant temperature detected by the coolant temperature sensor.

According to the above configuration, the target flow rate is set by using an equation based on the reference value obtained by dividing the difference between the cooling target temperature detected by the cooling target temperature sensor and the target cooling temperature by the difference between the cooling target temperature detected by the cooling target temperature sensor and the coolant temperature detected by the coolant temperature sensor in the circulation channel, which is arranged upstream of the inlet of the cooling channel. Unlike the case using various maps stored in the memory, much time for map setting is not required. Thus, the development cost can be reduced. In addition, since a memory having a small memory capacity can be adopted, the manufacturing cost can be reduced in combination with the reduced development cost.

In the cooling system, the electronic control unit may be configured to set the target flow rate by using the equation dividing the reference value by a predetermined time constant.

According to the above configuration, in the equation for setting the target flow rate, the predetermined time constant for dividing the reference value is used. Thus, a required cooling rate can be obtained.

The cooling system may further include an ambient temperature detection sensor that is configured to detect an ambient temperature of an environment surrounding the cooling target. The electronic control unit may be configured to set the target flow rate by using the equation multiplying the reference value by a difference between a predetermined reference ambient temperature and the ambient temperature detected by the ambient temperature sensor.

According to the above configuration, in the equation for setting the target flow rate, the reference value is multiplied by the difference between the predetermined reference ambient temperature and the ambient temperature detected by the ambient temperature sensor. Thereby, the target flow rate is set to be larger as the detected ambient temperature is higher with respect to the predetermined reference ambient temperature. Thus, it is possible to perform cooling with good responsiveness regardless of changes in the ambient temperature.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Hereinafter, embodiments implementing the present disclosure will be described with reference to the drawings.

First Embodiment

Figure 1:
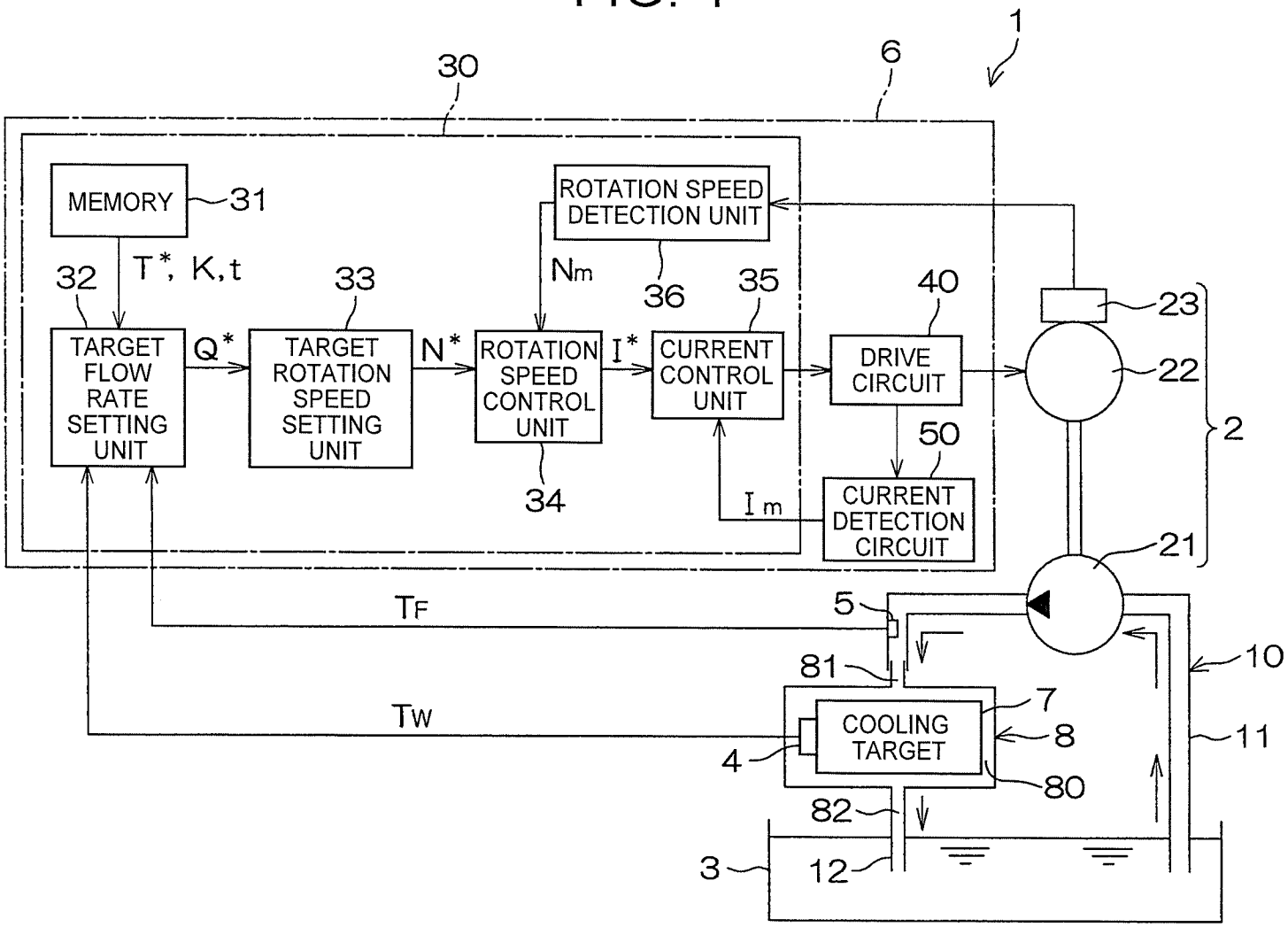
FIG. 1 is a block diagram of a schematic configuration of a cooling system according to a first embodiment of the present disclosure.

FIG. 1 is a block diagram showing a schematic configuration of a cooling system 1 according to a first embodiment of the present disclosure. As shown in FIG. 1, the cooling system 1 includes an electric pump 2, a reservoir tank 3, a cooling target temperature sensor 4, a coolant temperature sensor 5, and an electronic control unit (ECU) 6 serving as a control unit that controls a flow rate of the electric pump 2.

The electric pump 2 pumps the coolant into a circulation channel 10 in which heat can be exchanged with the cooling target 7. The cooling target 7 may be a motor for driving a wheel of a vehicle, an inverter connected to the motor, or a battery that supplies power to the motor via the inverter. The cooling target 7 is provided with a jacket 8 in which a cooling channel 80 is disposed. The coolant may be water or oil, for example.

The cooling channel 80 has an inlet 81 and an outlet 82. The circulation channel 10 connects the inlet 81 and the outlet 82 of the cooling channel 80. The reservoir tank 3 that temporarily stores the coolant is interposed part way through the circulation channel 10. The circulation channel 10 includes a supply channel 11 that connects the reservoir tank 3 and the inlet 81 of the cooling channel 80, and a discharge channel 12 that connects the outlet 82 of the cooling channel 80 and the reservoir tank 3. The electric pump 2 is interposed part way through the supply channel 11. The electric pump 2 pumps the coolant in the supply channel 11 toward the inlet 81 of the cooling channel 80.

The cooling target temperature sensor 4 detects a cooling target temperature $T_W$ that is a temperature of the cooling target 7. For example, when the cooling target 7 is the battery, the cooling target temperature sensor 4 detects the temperature of a battery cell as the cooling target temperature $T_W$. The coolant temperature sensor 5 is arranged upstream of the inlet 81 of the cooling channel 80 in the supply channel 11. The coolant temperature sensor 5 detects a coolant temperature $T_F$ that is a temperature of the coolant before being introduced into the cooling channel 80.

The electric pump 2 includes a pump body 21, an electric motor 22 that drives the pump body 21, and a rotation angle sensor 23 that detects a rotation angle of a rotor of the electric motor 22. The electric motor 22 of the electric pump 2 is controlled by the ECU 6. The cooling target temperature sensor 4, the coolant temperature sensor 5, and the rotation angle sensor 23 are electrically connected to the ECU 6.

The ECU 6 includes a microcomputer 30, a drive circuit (inverter circuit) 40 that is controlled by the microcomputer 30 and supplies power to the electric motor 22, and a current detection circuit 50 that detects a current (motor current $I_m$) that flows through the electric motor 22. The microcomputer 30 includes a CPU and a memory 31 (read-only memory (ROM), random-access memory (RAM), nonvolatile memory, etc.), and functions as a plurality of function processing units by executing a predetermined program. The function processing units include a target flow rate setting unit 32, a target rotation speed setting unit 33, a rotation speed control unit 34, a current control unit 35, and a rotation speed detection unit 36.

The memory 31 stores a target cooling temperature T*, a predetermined conversion constant K described later, a predetermined time constant t described later, etc. The target cooling temperature T* is an appropriate temperature for the cooling target 7 and is a value obtained in advance by an experiment using a system model. The target flow rate setting unit 32 receives input of the target cooling temperature T*, the predetermined conversion constant K, the predetermined time constant t, etc. from the memory 31. In addition, the target flow rate setting unit 32 receives input of the cooling target temperature $T_W$ detected by the cooling target temperature sensor 4. Further, the target flow rate setting unit 32 receives input of the coolant temperature $T_F$ detected by the coolant temperature sensor 5.

The target flow rate setting unit 32 calculates a target flow rate Q* using the following Equation (1) and outputs the target flow rate Q* to the target rotation speed setting unit 33.

$$Q^*=[K(T_W-T^*)]/[t(T_W-T_F)] \quad (1)$$

In Equation (1), K is the predetermined conversion constant set in advance and t is the predetermined time constant set in advance.

Equation (1) for setting the target flow rate Q* is based on a reference value B, the predetermined conversion constant K, and the predetermined time constant t. The reference value B $[B=(T_W-T^*)/(T_W-T_F)]$ is obtained by dividing a difference $(T_W-T^*)$ between the cooling target temperature $T_W$ detected by the cooling target temperature sensor 4 and the target cooling temperature T* by a difference $(T_W-T_F)$ between the cooling target temperature $T_W$ detected by the cooling target temperature sensor 4 and the coolant temperature $T_F$ detected by the coolant temperature sensor 5.

That is, in the calculation of Equation (1), the target flow rate Q* is calculated by dividing a multiplication value, which is obtained by multiplying the reference value B by the predetermined conversion constant K, by the predetermined time constant t ($Q^*=B\times K/t$). In other words, the target flow rate setting unit 32 sets the target flow rate Q* to be proportional to the difference $(T_W-T^*)$ between the cooling target temperature $T_W$ detected by the cooling target temperature sensor 4 and the target cooling temperature T*. That is, as the cooling target temperature $T_W$ is higher with respect to the target cooling temperature T*, the target flow rate Q* is set to be larger. Meanwhile, as the cooling target temperature $T_W$ becomes closer to the target cooling temperature T*, the target flow rate Q* is set to be smaller. Thus, it is possible to provide a flow rate suitable for cooling while suppressing unnecessary output.

Further, the target flow rate setting unit 32 sets the target flow rate Q* to be inversely proportional to the difference $(T_W-T_F)$ between the cooling target temperature $T_W$ detected by the cooling target temperature sensor 4 and the coolant temperature $T_F$ detected by the coolant temperature sensor 5. That is, as the difference $(T_W-T_F)$ between the cooling target temperature $T_W$ and the coolant temperature $T_F$ becomes larger, the target flow rate Q* is set to be smaller, and as the difference $(T_W\ T_F)$ between the cooling target temperature $T_W$ and the coolant temperature $T_F$ becomes smaller, the target flow rate Q* is set to be larger. Thus, in consideration of the cooling target temperature $T_W$ and the coolant temperature $T_F$, it is possible to provide a flow rate suitable for cooling while suppressing unnecessary output.

Further, the target flow rate setting unit 32 sets the target flow rate Q* to be inversely proportional to the predetermined time constant t. The target rotation speed setting unit 33 that has received input of the target flow rate Q* from the target flow rate setting unit 32 sets a target rotation speed N* based on the following Equation (2), and outputs the target rotation speed N* to the rotation speed control unit 34.

$$N^*=Q^*/(q\times\eta) \quad (2)$$

In Equation (2), q is a basic discharge amount (discharge amount per rotation) of the electric pump 2 and η is a volumetric efficiency of the electric pump 2. The rotation speed control unit 34 receives input of the target rotation speed N* output from the target rotation speed setting unit 33 and a detection signal (feedback signal) output from the rotation angle sensor 23. The rotation speed control unit 34 sets a target current I* so that the rotation speed of the electric motor 22 obtained based on the detection signal of the rotation angle sensor 23 becomes closer to the target rotation speed N*, and outputs the target current I* to the current control unit 35.

The current control unit 35 receives input of the target current I* output from the rotation speed control unit 34 and a motor current $I_m$ (feedback signal) detected by the current detection circuit 50. The current control unit 35 controls driving of the electric motor 22 via the drive circuit 40 so that the motor current $I_m$ becomes closer to the target current I*. In the present embodiment, the target flow rate Q* is set using Equation (1) based on a value (corresponding to the reference value B) obtained by dividing the difference ($T_W$−T*) between the cooling target temperature $T_W$ detected by the cooling target temperature sensor 4 and the target cooling temperature T* by the difference ($T_W$−$T_F$) between the cooling target temperature $T_W$ detected by the cooling target temperature sensor 4 and the coolant temperature $T_F$ detected by the coolant temperature sensor 5 in the circulation channel 10, which is arranged upstream of the inlet 81 of the cooling channel 80.

Unlike the related art in which various maps stored in the memory are used, much time for map setting is not required. Therefore, the development cost can be reduced. In addition, since a memory having a small memory capacity can be adopted, the manufacturing cost can be reduced in combination with the reduction in the development cost. Further, compared to the case where various maps are used, a load applied on the ECU 6 can be reduced and the target flow rate Q* can be set with good responsiveness. Thereby, it is possible to control the flow rate with good responsiveness and perform cooling with good responsiveness.

Further, a required cooling rate can be obtained by setting the target flow rate Q* to be inversely proportional to the predetermined time constant t.

Second Embodiment

Figure 2:
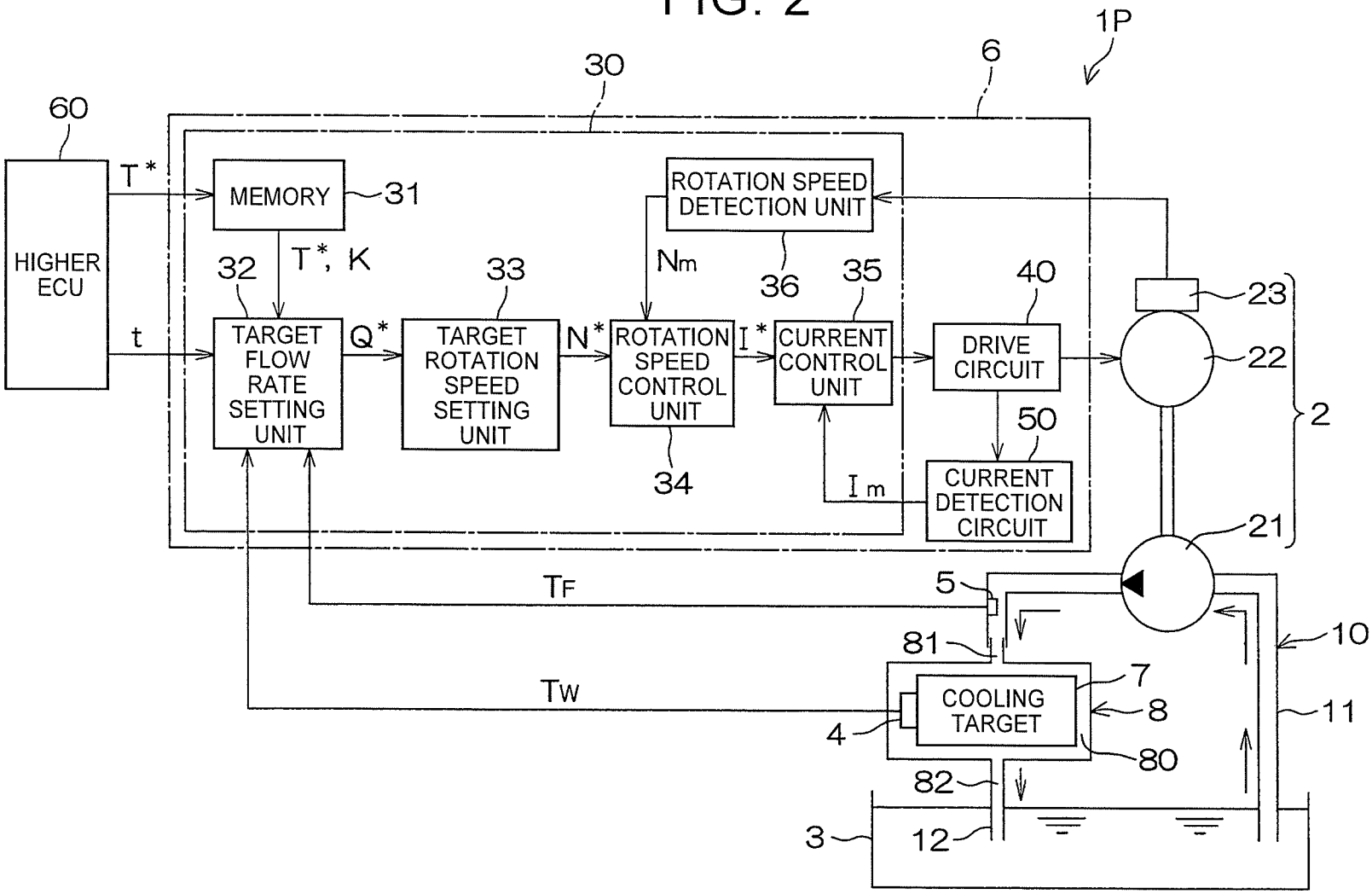
FIG. 2 is a block diagram of a schematic configuration of a cooling system according to a second embodiment of the present disclosure.

FIG. 2 is a block diagram showing a schematic configuration of a cooling system 1P according to a second embodiment of the present disclosure. The cooling system 1P according to the second embodiment in FIG. 2 differs from the cooling system 1 according to the first embodiment in FIG. 1 in that the target cooling temperature T* and the predetermined time constant t are provided to the ECU 6 for electric pumps from a higher ECU 60 of the vehicle via an on-vehicle network.

The target cooling temperature T* output from the higher ECU 60 is stored in the memory 31 of the ECU 6. The predetermined time constant t output from the higher ECU 60 is input to the target flow rate setting unit 32 of the ECU 6. In the present embodiment, by providing information from the higher ECU 60 of the vehicle, it is possible to perform control suitable for each type of the vehicle on which the electric pump 2 is mounted.

Third Embodiment

Figure 3:
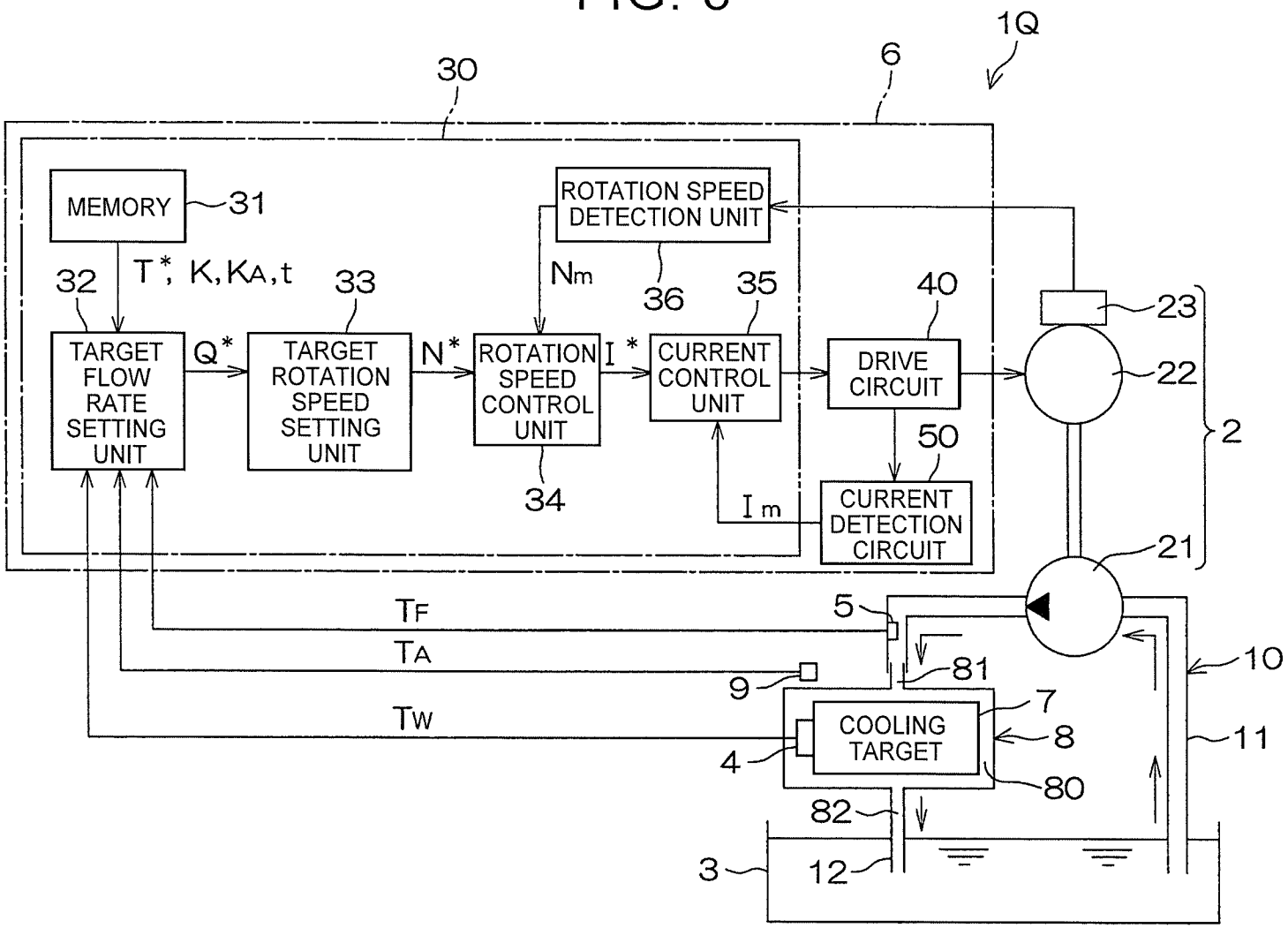
FIG. 3 is a block diagram of a schematic configuration of a cooling system according to a third embodiment of the present disclosure.

FIG. 3 is a block diagram showing a schematic configuration of a cooling system 1Q according to a third embodiment of the present disclosure. The cooling system 1Q according to the third embodiment in FIG. 3 differs from the cooling system 1 according to the first embodiment in FIG. 1 as follows.

That is, the cooling system 1Q is provided with an ambient temperature sensor 9 that detects an ambient temperature $T_A$ that is a temperature of air (an environment) surrounding the cooling target 7. The ambient temperature $T_A$ detected by the ambient temperature sensor 9 is input to the target flow rate setting unit 32. Further, the target flow rate setting unit 32 sets the target flow rate Q* based on the following Equation (3), and outputs the target flow rate Q* to the target rotation speed setting unit 33.

$$Q^*=[K(T_W-T^*)\times K_A(T_{A0}-T_A)]/[t\times(T_W-T_F)] \quad (3)$$

In Equation (3), K and $K_A$ are predetermined conversion constants that are set in advance and t is the predetermined time constant that is set in advance. The constants K, $K_A$, and t are stored in the memory 31 in advance. Equation (3) for setting the target flow rate Q* is based on a value [($T_W$−T*)/($T_W$−$T_F$)] (corresponding to the reference value B), a difference ($T_{A0}$−$T_A$) between a predetermined reference ambient temperature $T_{A0}$ and the ambient temperature ($T_A$) detected by the ambient temperature sensor 9, the predetermined conversion constants K and $K_A$, and the predetermined time constant t. In the calculation of Equation (3), the target flow rate Q* is calculated by dividing a multiplication value, which is obtained by multiplying the reference value B by the predetermined conversion constant K, the predetermined conversion constant $K_A$, and the difference ($T_{A0}$−$T_A$), by the predetermined time constant t (Q*=B×K×$K_A$×($T_{A0}$−$T_A$)/t).

That is, the target flow rate setting unit 32 sets the target flow rate Q* to be proportional to the difference ($T_W$−T*) between the cooling target temperature $T_W$ and the target cooling temperature T* and the difference ($T_{A0}$−$T_A$) between the reference ambient temperature $T_{A0}$ and the ambient temperature $T_A$, and to be inversely proportional to the difference ($T_W$−$T_F$) between the cooling target temperature $T_W$ and the coolant temperature $T_F$. The target flow rate setting unit 32 sets the target flow rate Q* to be inversely proportional to the time constant t.

In the present embodiment, as in the first embodiment, the target flow rate Q* is set using the equation, thereby the manufacturing cost can be reduced. Further, it is possible to control the flow rate with good responsiveness and perform the cooling with good responsiveness. In addition, the required cooling rate can be obtained by setting the target flow rate Q* to be inversely proportional to the predetermined time constant t. Further, in Equation (3) for setting the target flow rate Q*, the value [($T_W$−T*)/($T_W$−$T_F$)] (corresponding to the reference value B) is multiplied by the difference ($T_{A0}$−$T_A$) between the reference ambient temperature $T_{A0}$ and the ambient temperature $T_A$. Thereby, the target flow rate Q* is set to be larger as the detected ambient temperature $T_A$ is higher with respect to the predetermined reference ambient temperature $T_{A0}$. Thus, it is possible to perform the cooling with good responsiveness regardless of changes in the ambient temperature.

The present disclosure is not limited to the embodiments described above. For example, the vehicle on which the cooling target 7 is mounted may be an electric vehicle that uses a motor as a drive source, or may be a hybrid electric vehicle that selectively uses an engine and a motor as the drive source. As described above, the cooling target 7 may be a motor for driving a wheel of the vehicle, the inverter connected to the motor, or the battery that supplies power to the motor via the inverter. Alternatively, the cooling target 7 may be an engine serving as the drive source of the vehicle.

The cooling target 7 is not limited to a system mounted on the vehicle. The present disclosure may be otherwise variously modified within the scope of the claims.

What is claimed is:

1. A cooling system comprising:

an electric pump configured to pump a coolant to a circulation channel connected to an inlet and an outlet of a cooling channel in which heat is exchanged with a cooling target;

a cooling target temperature sensor configured to detect a cooling target temperature that is a temperature of the cooling target ($T_w$);

a coolant temperature sensor arranged upstream of the inlet in the circulation channel and configured to detect a coolant temperature that is a temperature of the coolant ($T_f$); and an electronic control unit configured to control driving of the electric pump such that a discharge flow rate of the electric pump matches a target flow rate, wherein the electronic control unit is configured to set the target flow rate (Q*) by using the following equation based on a reference value (B) obtained by dividing a difference between the cooling target temperature detected by the cooling target temperature sensor and a target cooling temperature of the cooling target by a difference between the cooling target temperature detected by the cooling target temperature sensor and the coolant temperature detected by the coolant temperature sensor, and multiplying the reference value by a value obtained by dividing a predetermined conversion constant (K) by a predetermined time constant (t):

$$B=(T_w-T^*)/T_w-T_f)$$

$$Q^*=B\times K/t.$$

2. The cooling system according to claim 1, further comprising:

an ambient temperature sensor configured to detect an ambient temperature of an environment surrounding the cooling target, wherein the electronic control unit is configured to set the target flow rate by using the equation multiplying the reference value by a difference between a predetermined reference ambient temperature and the ambient temperature detected by the ambient temperature sensor.

* * * * *